US012121117B1

(12) United States Patent
Cicchitto et al.

(10) Patent No.: US 12,121,117 B1
(45) Date of Patent: Oct. 22, 2024

(54) ROTATABLE POLYMORPHIC RING

(71) Applicant: JNel Jewelry Corporation, Pleasanton, CA (US)

(72) Inventors: Nelson A. Cicchitto, San Ramon, CA (US); Jami Cicchitto, San Ramon, CA (US)

(73) Assignee: JNel Jewelry Corporation, Pleasanton, CA (US)

( * ) Notice: Subject to any disclaimer, the term of this patent is extended or adjusted under 35 U.S.C. 154(b) by 0 days.

(21) Appl. No.: 18/599,099

(22) Filed: Mar. 7, 2024

Related U.S. Application Data

(63) Continuation of application No. 29/925,302, filed on Jan. 23, 2024.

(51) Int. Cl.
*A44C 9/00* (2006.01)
*A44C 19/00* (2006.01)

(52) U.S. Cl.
CPC ..... *A44C 19/00* (2013.01); *A44C 9/0053* (2013.01)

(58) Field of Classification Search
CPC ..... A44C 9/0053; A44C 9/00
USPC ..... D11/26, 29, 34, 37, 38, 39; 63/15, 15.7
See application file for complete search history.

(56) References Cited

U.S. PATENT DOCUMENTS 1,280,707 A 10/1918 Gebhardt
7,222,503 B2 5/2007 Golove
D873,166 S * 1/2020 Huang ..... D11/34
D884,540 S 5/2020 Chak et al.
11,470,926 B1 10/2022 Marmershteyn et al.
2013/0305783 A1 11/2013 Sutton
2019/0387847 A1* 12/2019 Sen Gupta ..... B22D 25/026
2021/0401129 A1* 12/2021 Talasazan ..... A44C 27/00
(Continued)

FOREIGN PATENT DOCUMENTS

CN 113966903 A 1/2022
JP 2006006973 A 1/2006
JP 2008012316 A 1/2008
(Continued)

OTHER PUBLICATIONS

"Rotatable Secret Decoder Ring Unisex Personalized Ring Jewelry", https://www.pinterest.com/pin/744008800941795978/; retrieved from the Internet on Oct. 11, 2023., 3 pp.
(Continued)

*Primary Examiner* — Jack W Lavinder
(74) *Attorney, Agent, or Firm* — Perkins Coie LLP; Michael A. Glenn

(57) ABSTRACT

A ring includes a first-half side formed of a first metal, a second-half side formed of a second metal, where the second half side adjacent and symmetrical to the first-half side. The ring includes a third-half side of the first metal and faces in the opposite direction of the first-half side and a fourth-half side of the second metal, the fourth-half side adjacent and symmetrical to the third-half side and faces in the opposite direction of the second-half side. The ring includes a first pattern of indicia embedded in the first metal and a second pattern of indicia embedded in the second metal. The ring includes a first recessed annular pattern of on the same side as the first-half side and the second-half side and a second recessed annular pattern of indicia on the same side as the third-half side and the fourth-half side.

18 Claims, 8 Drawing Sheets

(56) References Cited

U.S. PATENT DOCUMENTS

2023/0292889 A1* 9/2023 Schiffer ..... G06K 19/07762

FOREIGN PATENT DOCUMENTS

| | | | |
|---|---|---|---|
| JP | 2011194195 | A | 10/2011 |
| JP | 5188704 | B2 | 2/2013 |
| JP | 2022054861 | A | 4/2022 |
| KR | 200460469 | Y1 | 5/2012 |
| KR | 102546393 | B1 | 6/2023 |
| WO | 2004084669 | A2 | 10/2004 |

OTHER PUBLICATIONS

"The Titanium Steel Multi-layer Rotating Ring—Stylish and a Little Fun", https://gizmodern.com/products/the-titanium-steel-multi-layer-rotating-ring-stylish-and-a-little-fun; retrieved from the Internet on Oct. 11, 2023., 28 pp.

"Topoint Rotatable Titanium Stainless Steel Fidget Band Rings for Women Men Boys Teen Girls Dainty Anti Anxiety Stress Relief Spinner Rings Minimalist Statement Promise Couple Rings", https://www.walmart.com/ip/TOPOINT-Rotatable-Titanium-Stainless-Ste...alist-State/3761537490"wmlspartner=wlpa&selectedSellerId=101121742; retrieved from the Internet on Oct. 11, 2023., 7 pp.

* cited by examiner

ROTATABLE POLYMORPHIC RING

CROSS-REFERENCE TO RELATED APPLICATION

This patent application is a continuation of copending U.S. Design application Ser. No. 29/925,302 POLYMORPHIC RING, filed Jan. 23, 2024, which is incorporated herein by reference in its entirety.

TECHNICAL FIELD

The invention relates to a rotatable ring having multiple sides for selectively displaying multiple jewels, metals, and colors and, more particularly, a ring that can selectively display various jewels, metals, and colors according to a user preference.

BACKGROUND

Rings are quite popular among members of society and have been since ancient times. A ring can be an ornamental piece of jewelry that is worn on a finger to demonstrate the status of the person, the person's mood, and for whatever reason the wearer chooses. Typically, the ring is adorned with jewels, stones, and other valuable assets. The person wearing the ring most often than not ensures that their preferred ornament is visible to onlookers. For instance, if a ring has a large sapphire stone deposed on it, the wearer rotates the ring so that such sapphire is fully visible at the top part of the finger and not twisted to the side or worse, to the inside of the hand.

Today, users buy multiple rings to suit their multiple purposes. A user might wear their sapphire ring for one type of occasion and their ruby ring for another occasion. To fulfill the user's desire to have multiple types of rings can be a costly and inefficient endeavor. The user has to purchase two base rings for the purposes of having one sapphire ring and one ruby ring. As well, the user has to store and maintain these multiple rings, which can lead to inefficiencies in storage, cleaning, and repair.

SUMMARY

In some aspects, the techniques described herein relate to a ring with at least two facets to selectively display at least two jewels, metals, or colors, the ring including: a first half side formed of a first metal material; a second half side formed of a second metal material, the second half side adjacent to and symmetrical to the first half side; a third half side formed of the first metal material and outwardly facing in the opposite direction of the first half side; a fourth half side formed of the second metal material, the fourth half side adjacent to and symmetrical to the third half side and outwardly facing in the opposite direction of the second half side; a first pattern of first indicia embedded in the first metal material; a second pattern of second indicia embedded in the second metal material; a first recessed annular pattern of a third indicia on a same side as the first half side and the second half side; and a second recessed annular pattern of a fourth indicia on a same side as the third half side and the fourth half side.

In some aspects, the techniques described herein relate to a ring, wherein the first indicia, second indicia, third indicia, and fourth indicia are jewels or engravings.

In some aspects, the techniques described herein relate to a ring, wherein the first metal material and the second metal material are any of: white gold, yellow gold, rose gold, or titanium steel.

In some aspects, the techniques described herein relate to a ring, further including a grill design in the interior surface of the ring.

In some aspects, the techniques described herein relate to a ring, wherein the grill design includes a receptacle for the placement of an element.

In some aspects, the techniques described herein relate to a ring, wherein the element is any of: a jewel, a radio-frequency identification (RFID) chip, or an electronic element configured to process a transaction.

In some aspects, the techniques described herein relate to a ring, wherein the grill design includes a serial number of the ring.

In some aspects, the techniques described herein relate to a ring, wherein the first annular pattern or the second annular pattern includes a plurality of jewels or a design formed in the metal thereof.

In some aspects, the techniques described herein relate to a ring, wherein: a width of the first pattern of first indicia includes three spaced rounded jewels; or a width of the second pattern of second indicia includes three spaced vertical rectangular jewels or two spaced horizontal rectangular jewels.

In some aspects, the techniques described herein relate to a ring, wherein a space where the first metal material and the second metal material meet is the vertical height of one or two jewels from the first pattern of first indicia embedded in the first metal material or from the second pattern of second indicia embedded in the second metal material.

In some aspects, the techniques described herein relate to a ring, wherein the first indicia, second indicia, third indicia, and fourth indicia include precious stones, the precious stones including any of or any combination of: diamonds, rubies, emeralds, and sapphires.

In some aspects, the techniques described herein relate to a method for orienting at least two facets of a ring to selectively display at least two jewels, metals, or colors, of the ring, the method including: providing a first half side formed of a first metal material; providing a second half side formed of a second metal material, the second half side adjacent to and symmetrical to the first half side; providing a third half side formed of the first metal material and outwardly facing in the opposite direction of the first half side; providing a fourth half side formed of the second metal material, the fourth half side adjacent to and symmetrical to the third half side and outwardly facing in the opposite direction of the second half side; providing a first pattern of first indicia embedded in the first metal material; providing a second pattern of second indicia embedded in the second metal material; providing a first recessed annular pattern of a third indicia on a same side as the first half side and the second half side; and providing a second recessed annular pattern of a fourth indicia on a same side as the third half side and the fourth half side.

In some aspects, the techniques described herein relate to a method, wherein the first indicia, second indicia, third indicia, and fourth indicia are jewels or engravings.

In some aspects, the techniques described herein relate to a method, wherein the first indicia, second indicia, third indicia, and fourth indicia include precious stones, the precious stones including any of or any combination of: diamonds, rubies, emeralds, and sapphires.

In some aspects, the techniques described herein relate to a method, wherein the first metal material and the second metal material are any of: white gold, yellow gold, rose gold, or titanium steel.

In some aspects, the techniques described herein relate to a method, further including: providing a grill design in the interior of the ring.

In some aspects, the techniques described herein relate to a method, wherein the grill design includes a receptacle for the placement of an element.

In some aspects, the techniques described herein relate to a method, wherein the element is any of: a jewel, a radio-frequency identification (RFID) chip, or an electronic element configured to process a transaction.

In some aspects, the techniques described herein relate to a method, wherein the grill design includes a serial number of the ring.

In some aspects, the techniques described herein relate to a method, wherein the first annular pattern or the second annular pattern includes a plurality of jewels or a design formed in the metal thereof.

In some aspects, the techniques described herein relate to a ring, including: an outside ring formed by a material which has at least one opening or transparent section thereon; an inside ring having at least one design on the surface thereof that meets with the outside ring; and a locking mechanism that secures the inside ring completely inside the outside ring coaxially; wherein the outside ring or the inside ring is rotatable with respect to the inside ring or outside ring, respectively; and wherein the rotation of the outside or inside rings can cause any of the at least one design to be located underneath the at least one opening or transparent section of the outside ring, thereby allowing the design of the inside ring to be visible through the outside ring.

DETAILED DESCRIPTION

Figure 1:
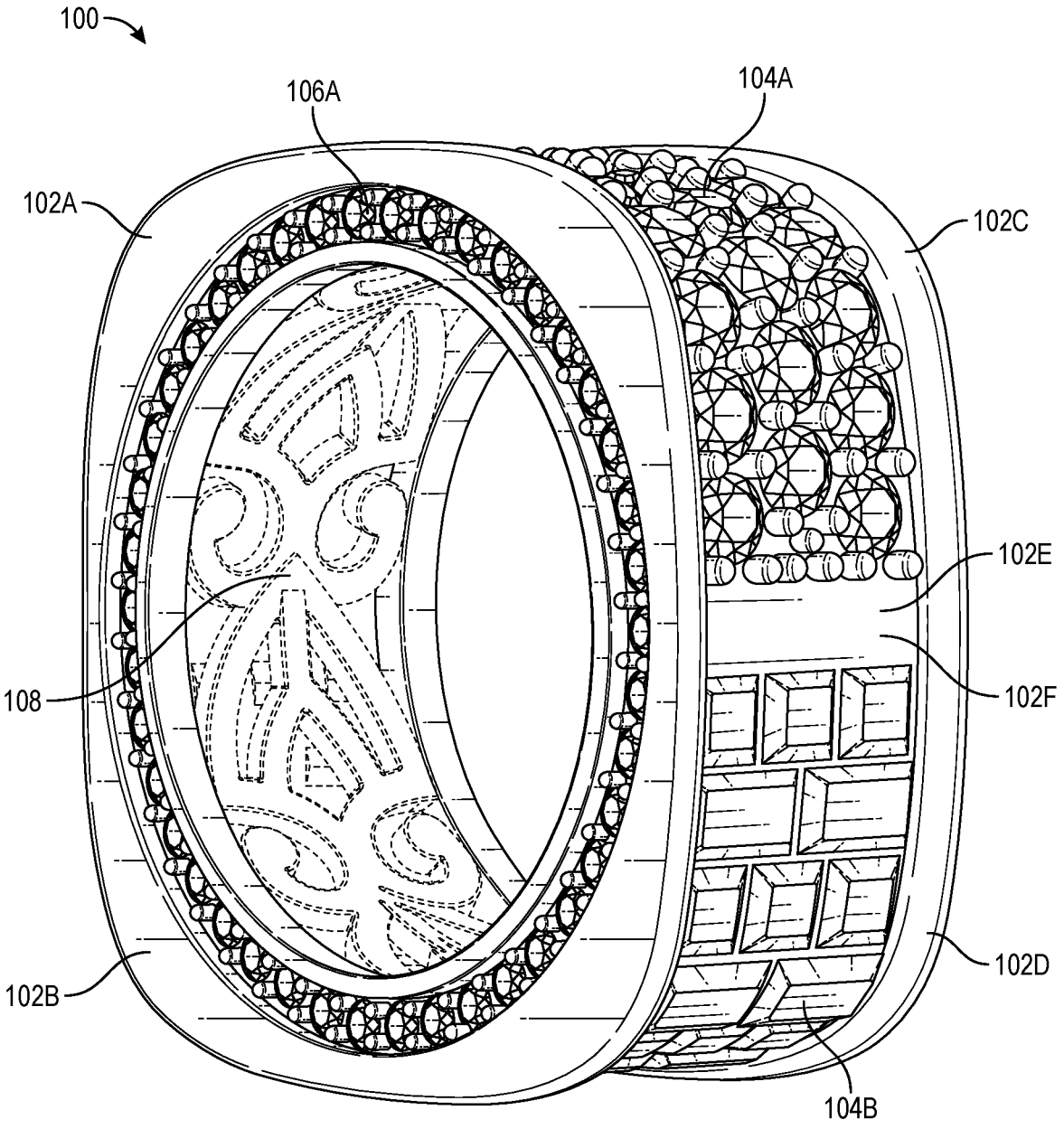
FIG. 1 is a first perspective view of a rotatable polymorphic ring to selectively display multiple jewels, metals, and colors, consistent with embodiments herein.

To overcome some of the technical problems discussed above, one object of the innovation is to provide a singular ring that has multiple facets to selectively display different views of such ring, according to a user's or wearer's preference. In an embodiment, a facet is a specifically designed part of the ring with the intent of such facet being visible to the external environment. However, a facet can also be hidden to the external environment. For example, the wearer can wear the innovative ring to display a specific design of specifically cut diamonds embedded in white gold positioned at the top of the user's hand. In addition, the user can wear such ring so that an array of diamonds that are embedded in the side portion of the ring are displayed facing the outside of the wearer, such as towards a person to whom the wearer is speaking. In another instance, with the same ring, the user can twist the ring while on their finger to wear such that the facet is positioned in a different orientation. For example, the wearer can twist the ring around 180 degrees about the axis that runs in the same direction as the finger wearing the ring. In the example, the twisting results in a yellow gold base embedded with a different set of cut diamonds now are oriented to display at the top of the user's hand. In addition, the user can take the ring off and flip it around 180 degrees about an axis that is perpendicular to the finger wearing the ring, to present the ring in yet another orientation. For instance, by such flipping, a braid design, which was imprinted on the side of the ring that was facing the user, is now facing outward, such as towards a person to whom the user is facing.

It should be appreciated that the specific types of metals, e.g. white gold, yellow gold, rose gold, titanium steel, and stones, e.g. diamonds, rubies, emeralds, sapphires, are by way of example and are not meant to be limiting. In some embodiments, in place of the metal material can be for example but not limited to platinum, graphite, cloth, rubber, and plastic. In some embodiments, the diamonds can be for example but not limited to mined diamonds, lab-grown diamonds, clarity enhanced diamonds, and man-made diamonds, synthetic diamonds, and moissanite diamonds. In some embodiments, objects other than stones can be used. Examples of such other objects but not limited to are light-emitting diodes (LEDs), micro-LEDs, solar-powered lights, and objects that glow in the dark. Further, the types of design of the diamonds and braid are by example and are not meant to be limiting. It should be appreciated that the above-mentioned elements can be mounted on the top and bottom portions of the ring as well as the inner annular regions which are visible on the side of the ring. For example, a user might be wearing a red dress for a special occasion. By way of the innovation, the user can choose to wear the facet of their ring that shows the red rubies, presuming that their ring has red rubies positioned at one side of their ring. More specifically, the user can twist their ring to where the red ruby pattern side of the ring is displayed at the top for all those nearby to see.

It should be appreciated that in accordance with embodiments herein, the term, user, is used interchangeably with the term, wearer.

An embodiment can be described with reference to FIG. 1, a first perspective view of a rotatable polymorphic ring 100 to selectively display multiple jewels, metals, or colors. In an embodiment polymorphic ring means a ring having two or more different types of displays, interfaces, facets, or sides. The rotatable polymorphic ring 100 includes a first half side 102A formed of a first metal material. For example, the first metal material can be yellow gold. The rotatable polymorphic ring 100 also includes a second half side 102B formed of a second metal material, the second half side adjacent to and symmetrical to the first half side 102A. Rotatable polymorphic ring 100 also includes a third half side 102C formed of the first metal material and outwardly facing in the opposite direction of the first half side 102A. Rotatable polymorphic ring 100 also includes a fourth half side 102D formed of the second metal material, the fourth half side adjacent to and symmetrical to the third half side 102C and outwardly facing in the opposite direction of the second half side 102B.

In some embodiments, rotatable polymorphic ring 100 includes more than the half sides described above. For instance, rotatable polymorphic ring 100 can be of octagonal shape and have eight sides, each having its own pattern of stones or engraving or none thereon. Another example is rotatable polymorphic ring 100 being of hexagonal shape, having six specific sides.

In an embodiment, rotatable polymorphic ring 100 includes a boundary of the first metal material 102E and the boundary of the second metal material 102F, which is adjacent to the boundary of the first metal material 102E, as shown in FIG. 1. While no specific line is drawn, one skilled in the art can readily acknowledge that, after manufacturing the ring, first metal material 102E meets second metal material 102F at a specific area in the mold of the two metals.

Rotatable polymorphic ring 100 includes a first pattern of first jewels 104A embedded in or mounted on the surface of the first metal material on the same side of the ring as the first half side 102A and the third half side 102C. Such embedding or mounting of the stones or engraving are performed in accordance with conventional techniques. In some embodiments the surface of 104A includes engraving in part or entirely. For example, a person's signature can be inscribed. Rotatable polymorphic ring 100 includes a second pattern of second jewels 104B embedded in the second metal material, similarly to the embedding or mounting of stones or engraving as described with reference to 104A.

Rotatable polymorphic ring 100 includes a first recessed annular pattern 106A of a third type of jewel or other indicia on the same side of the ring as the second half side 102B and the fourth half side 102D. As shown and in accordance with embodiments herein, first recessed annular pattern 106A is positioned between two concentric circles formed in first half side 102A and second half side 102B. Rotatable polymorphic ring 100 also includes a second annular pattern 106B (see FIG. 3) on third half side 102C and fourth half side 102D. That is, second annular pattern 106B is symmetric to and on the opposite side of first half side 102A and second half side 102B.

Figure 2:
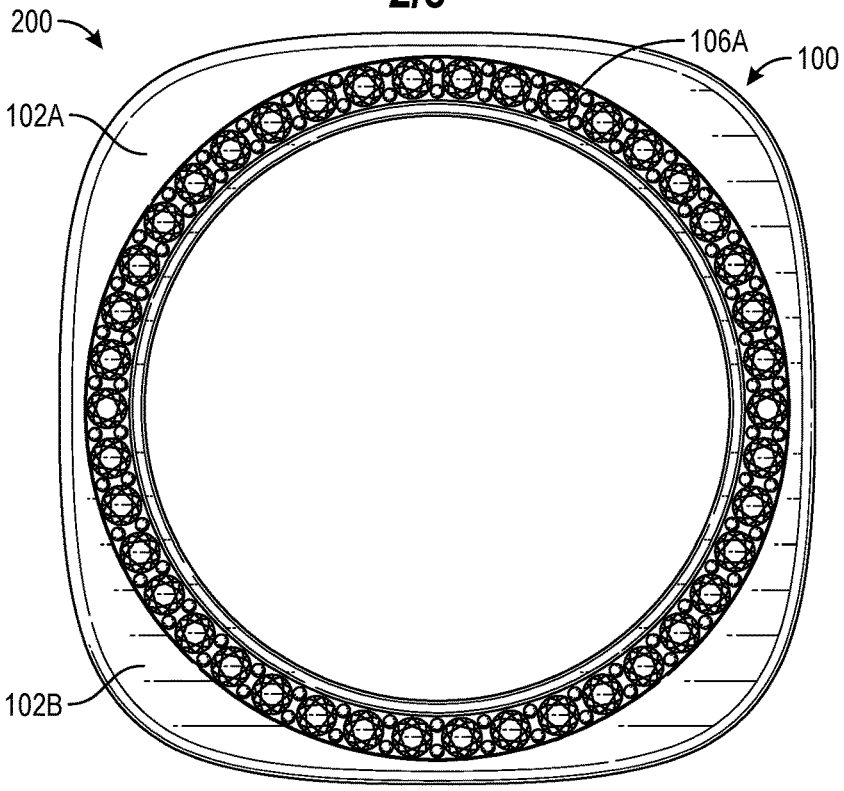
FIG. 2 is a first side view of a rotatable polymorphic ring to selectively display multiple jewels, metals, and colors, consistent with embodiments herein.
Figure 3:
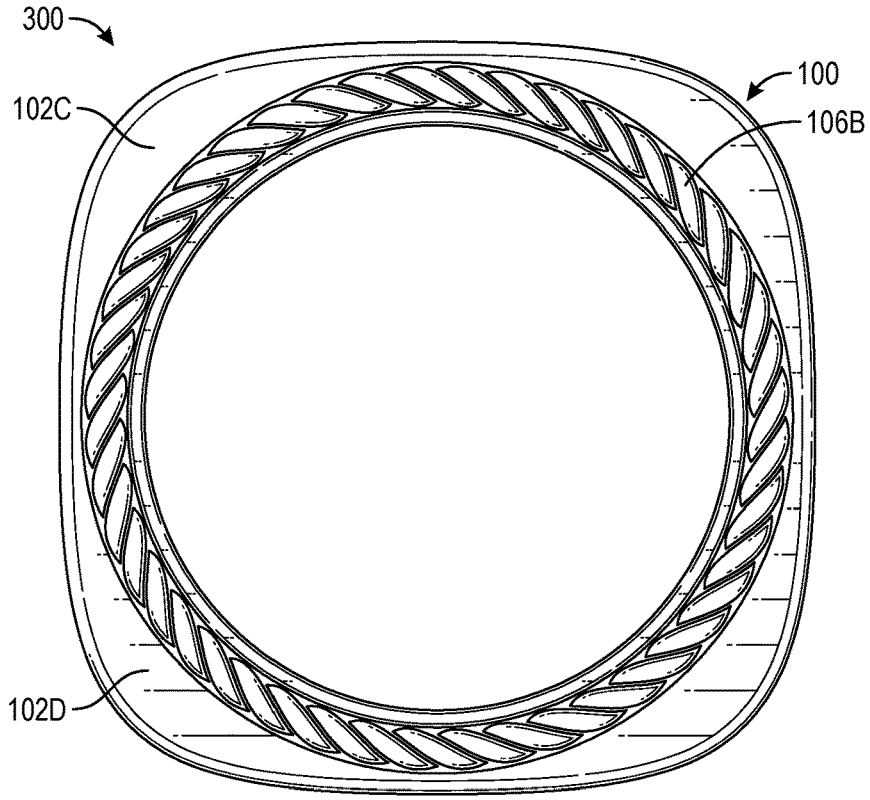
FIG. 3 is a second side view of a rotatable polymorphic ring to selectively display multiple jewels, metals, and colors, consistent with embodiments herein.

The design pattern on first recessed annular pattern 106A or second annular pattern 106B can be scalloping, where one of a continuous series of circular segments or angular projections, as shown in FIG. 1-3. In some embodiments, other patterns are formed in 106A or 106B. For example, a pattern of alternating diamonds and precious stones is contemplated. As other examples, an engravement, such as "I love you" or the initials of the owner can be positioned in 106A or 106B.

In some embodiments rotatable polymorphic ring 100 includes a grill or other design forming a grill 108 on or forming the inside of the ring and discussed in further detail below.

FIG. 2 is a first side view 200 of the rotatable polymorphic ring 100 to selectively display multiple jewels, metals, and colors, consistent with embodiments herein. This view shows the implementation of the two sides, 102A and 102B, each formed of respective and different metals. Also shown is first recessed annular pattern 106A.

FIG. 3 is a second side view 300 of the rotatable polymorphic ring 100 to selectively display multiple jewels, metals, and colors, consistent with embodiments herein. This view shows the implementation of the two sides, third half side 102C and fourth half side 102D, each formed of respective and different metals. Also shown is second annular pattern 106B of a fourth type of jewel or other indicia. Here, second annular pattern 106B is formed of a rope-like pattern made of the first metal and second metal, respectively. Thus, the user may decide to hide the first recessed annular pattern 106A consisting of diamonds by wearing the ring such that the first recessed annular pattern 106A faces the inside direction, towards the user. Then, in accordance with this implementation, the rope-like pattern of second annular pattern 106B is displayed in the outside direction. If a user is next to and speaking with a person, that person, upon looking at the ring on the user's finger, would see the rope-like pattern as opposed to the diamond-studded pattern of first recessed annular pattern 106A.

Figure 4:
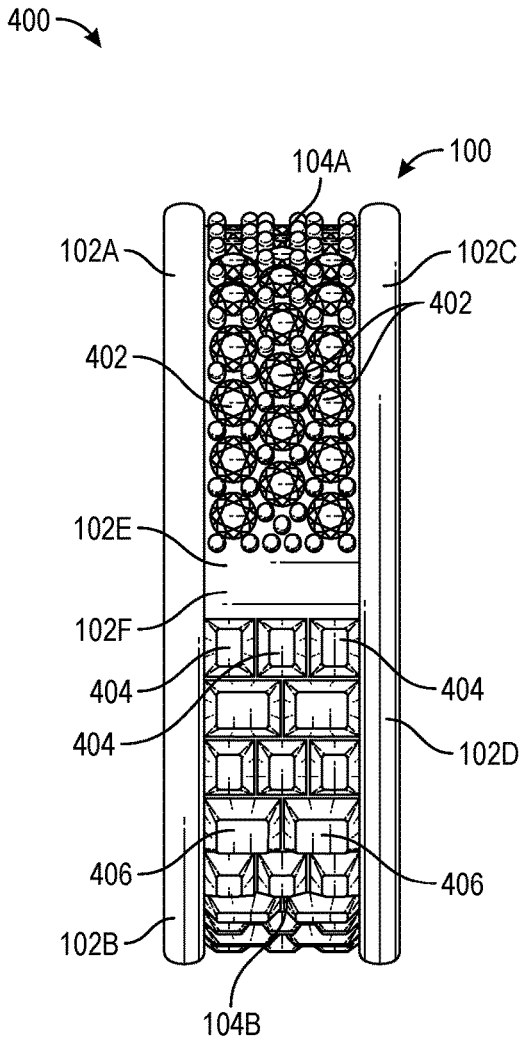
FIG. 4 is a third side view of a rotatable polymorphic ring to selectively display multiple jewels, metals, and colors, consistent with embodiments herein.

FIG. 4 is a third side view 400 of a rotatable polymorphic ring 100 to selectively display multiple jewels, metals, and colors, consistent with embodiments herein. Also shown in this implementation are all four sides 104A-D, respectively; the region where the two types of metal meet 102E-F; and the first pattern of first jewels 104A and the second pattern of second jewels 104B. The thickness of the ring, shown here as the width from 102A to 102C or 102B to 102D, can be considered here to be as wide as three spaced rounded diamonds 402. Put another way, the width of the ring can be the width of the first pattern of first jewels 104A. Or the thickness of the ring can be considered here to be as wide as three spaced vertical rectangular diamonds 404 or two spaced horizontal rectangular diamonds 406. Put another way, the width of the ring can be the width of the second pattern of second jewels 104B.

It should be appreciated that the above described implementation of the width of rotatable polymorphic ring 100 is by way of example and is not meant to be limiting. The width of rotatable polymorphic ring 100 can be made smaller than this example or wider than this example and be consistent with embodiments herein. For instance, three spaced rounded diamonds 402 can be modified to remove one of such three diamonds and three spaced vertical rectangular diamonds 404 can be modified to remove one of such three diamonds. Also, in an embodiment a space where the first metal material and the second metal material meet has a vertical height of one or two jewels from the first pattern of first indicia embedded in the first metal material or from the second pattern of second indicia embedded in the second metal material.

Figure 5:
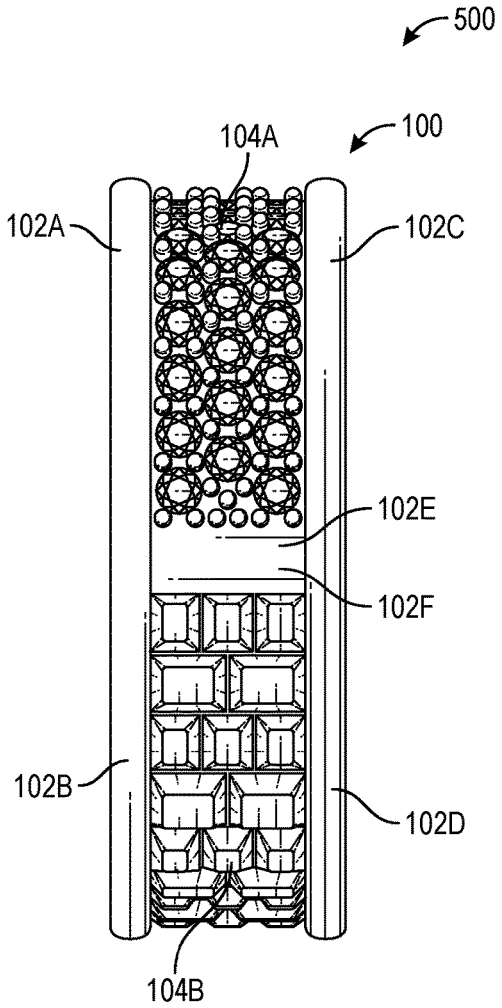
FIG. 5 is a fourth side view of a rotatable polymorphic ring to selectively display multiple jewels, metals, and colors, consistent with embodiments herein.

FIG. 5 is a fourth side view 500 of a rotatable polymorphic ring 100 to selectively display multiple jewels, metals, and colors, consistent with embodiments herein. The discussion above for FIG. 4 applies here as well.

Figure 6:
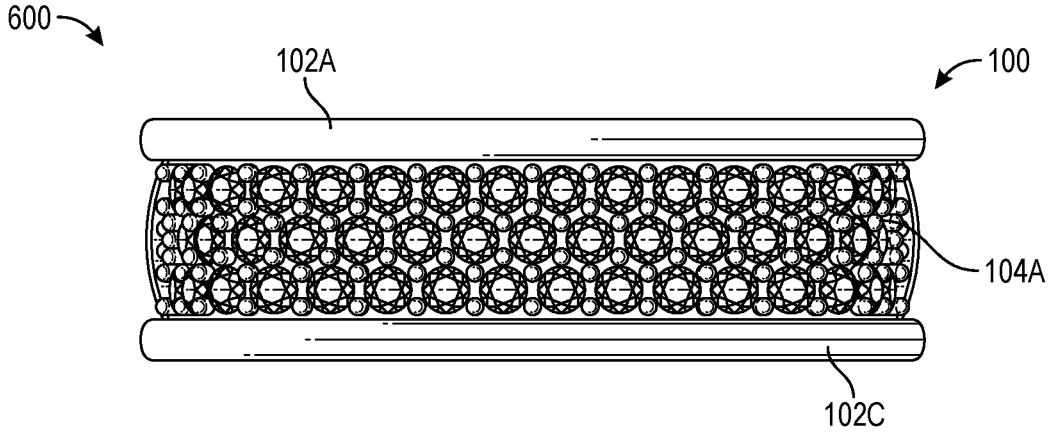
FIG. 6 is a first top view of a rotatable polymorphic ring to selectively display multiple jewels, metals, and colors, consistent with embodiments herein.

FIG. 6 is a first top view 600 of a rotatable polymorphic ring 100 to selectively display multiple jewels, metals, and colors, consistent with embodiments herein. Shown here are first half side 102A, first pattern of first jewels 104A, and third half side 102C. The discussion above for FIG. 1-5 apply here as well. FIG. 4-5 are side views with respect to FIG. 6 being a top view.

Figure 7:
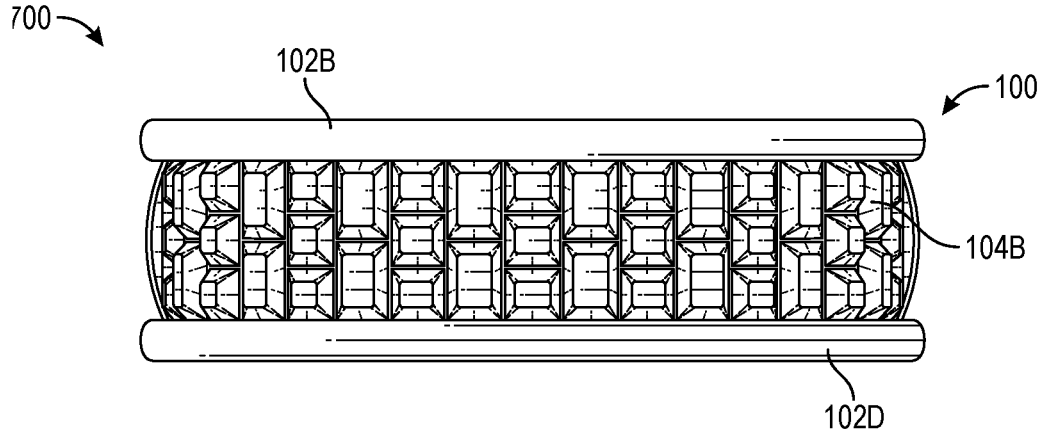
FIG. 7 is a second top view of a rotatable polymorphic ring to selectively display multiple jewels, metals, and colors, consistent with embodiments herein.

FIG. 7 is a second top view 700 of a rotatable polymorphic ring 100 to selectively display multiple jewels, metals, and colors, consistent with embodiments herein. Specifically, in relation to FIG. 6, here the bottom portion of FIG. 6 is visible, on the outside of the user's hand. In an example consistent with embodiments herein, the wearer of rotatable polymorphic ring 100 of FIG. 6 has rotated such ring on their finger (or, alternatively, take off the ring and put the ring back on a finger) about the axis parallel to their finger so that what was the bottom side of FIG. 6 is now shown, as depicted in FIG. 7. Shown here are second half side 102B, second pattern of second jewels 104B, and fourth half side 102D. As another example, the user can reposition the rotatable polymorphic ring so that the prominent portion is obscured. For instance, the user might want to hide their valuable jewels in the facet that is now hidden.

Figure 8:
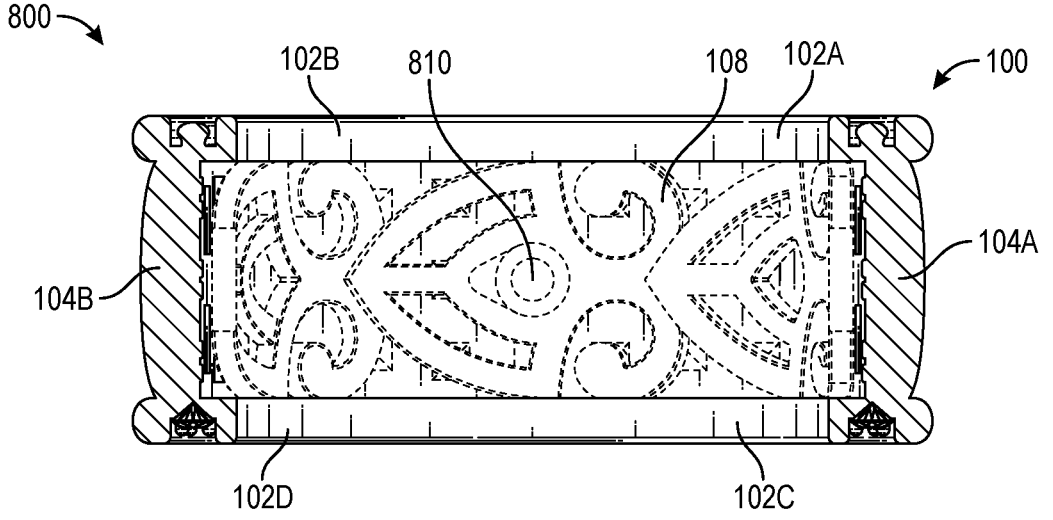
FIG. 8 is a cross-section view of a rotatable polymorphic ring to selectively display multiple jewels, metals, and colors, showing an inside view, consistent with embodiments herein.

FIG. 8 is a cross-section view 800 of a rotatable polymorphic ring 100 to selectively display multiple jewels, metals, and colors, showing an inside view, consistent with embodiments herein. Grill 108 can be any type of design that suits the wearer and that can be adapted to be formed as the inside of rotatable polymorphic ring 100 in a way that is comfortable to the user. Grill 108 can be a design spanning a spectrum of no design (e.g., only the metals that form rotatable polymorphic ring 100) to a very detailed and elaborate design. For instance, grill 108 can have engraved thereof the serial number of the ring, a personal inscription that has meaning to the wearer, and the like. The design of grill 108 as shown is one such design and is not meant to be limiting.

In some embodiments grill 108 includes a receptacle 810 for holding an element. Examples of such element are a jewel; an electronic chip (e.g., an radio-frequency identification (RFID) chip); electronics to enable tap to pay by tapping the ring near or at the point of relevant contact relating to a financial transaction; and so forth. It should be appreciated that the multitude of example elements listed above (e.g., LEDs, micorLEDs, and so on) can be used or mounted inside the receptable 810 as well.

Figure 9:
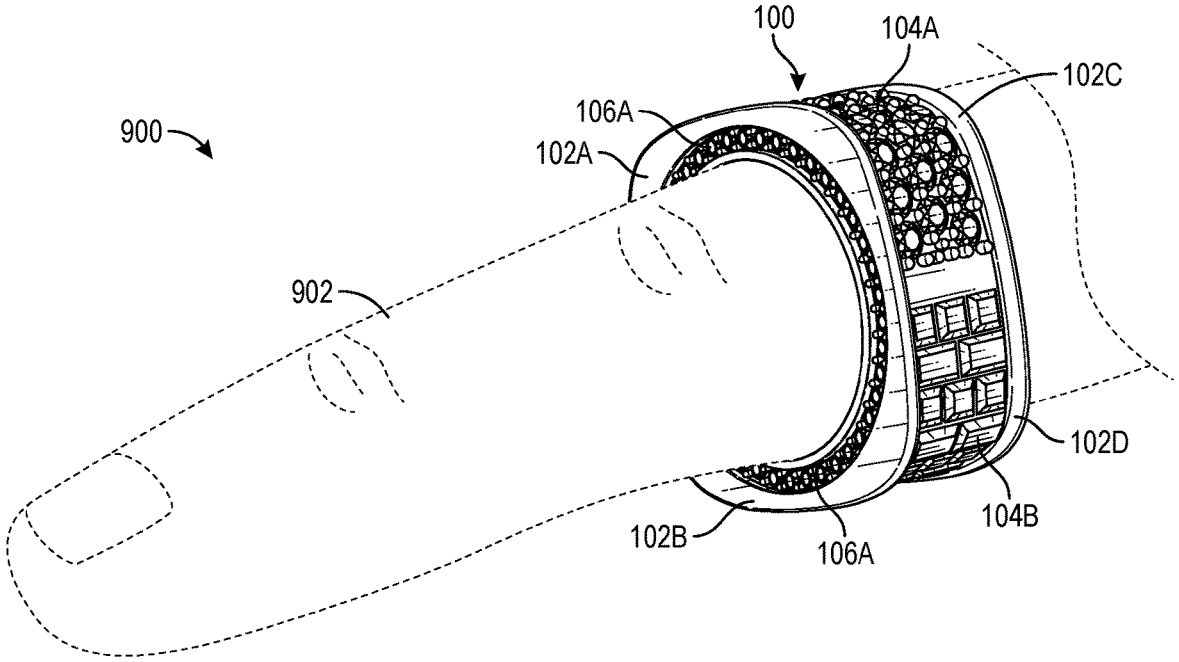
FIG. 9 is a second perspective view of a rotatable polymorphic ring to selectively display multiple jewels, metals, and colors, showing the ring on a finger, consistent with embodiments herein.

FIG. 9 is a second perspective view 900 of a rotatable polymorphic ring 100 to selectively display multiple jewels, metals, and colors, showing the ring on a finger 902 of a wearer, consistent with embodiments herein. Shown here for illustrative purposes are first half side 102A, second half side 102B, third half side 102C, fourth half side 102D, first pattern of first jewels 104A, second pattern of second jewels 104B, and first recessed annular pattern 106A.

Figure 10:
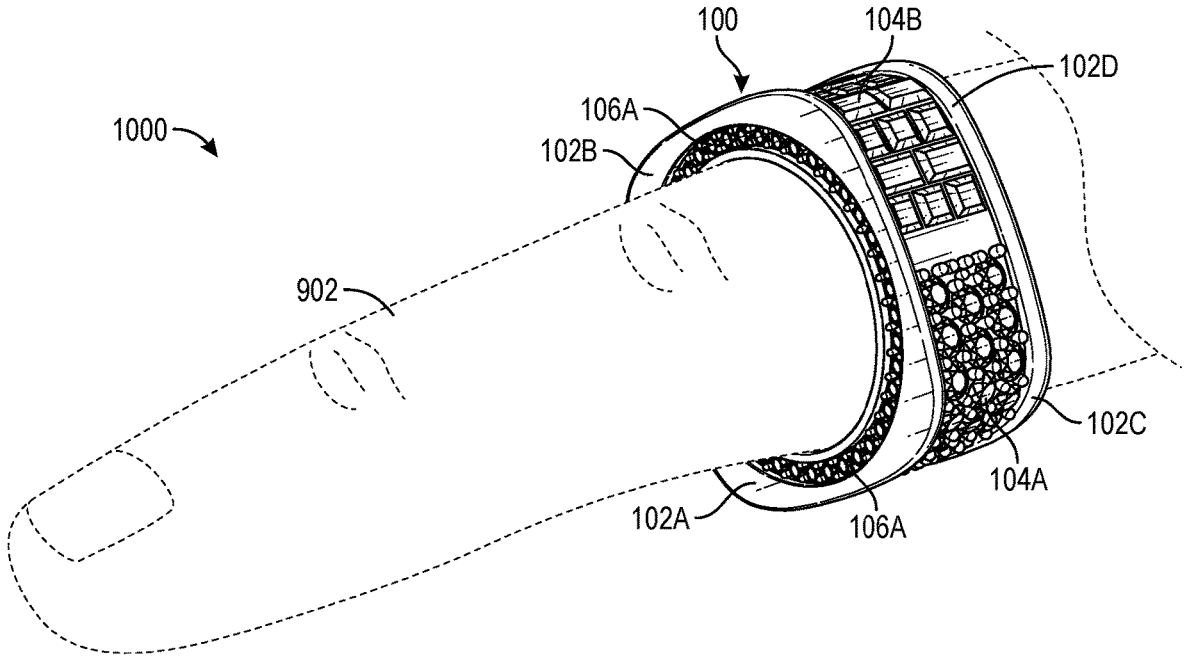
FIG. 10 is a third perspective view of a rotatable polymorphic ring to selectively display multiple jewels, metals, and colors, showing the ring on a finger, consistent with embodiments herein.

FIG. 10 is a third perspective view 1000 of a rotatable polymorphic ring 100 to selectively display multiple jewels, metals, and colors, showing the ring on a finger 902, consistent with embodiments herein. Here, relative to FIG. 9, the user has rotated such ring so that second pattern of second jewels 104B are displayed at the top of finger 902, as opposed to being displayed at the bottom of finger 902 in FIG. 9.

Figure 11:
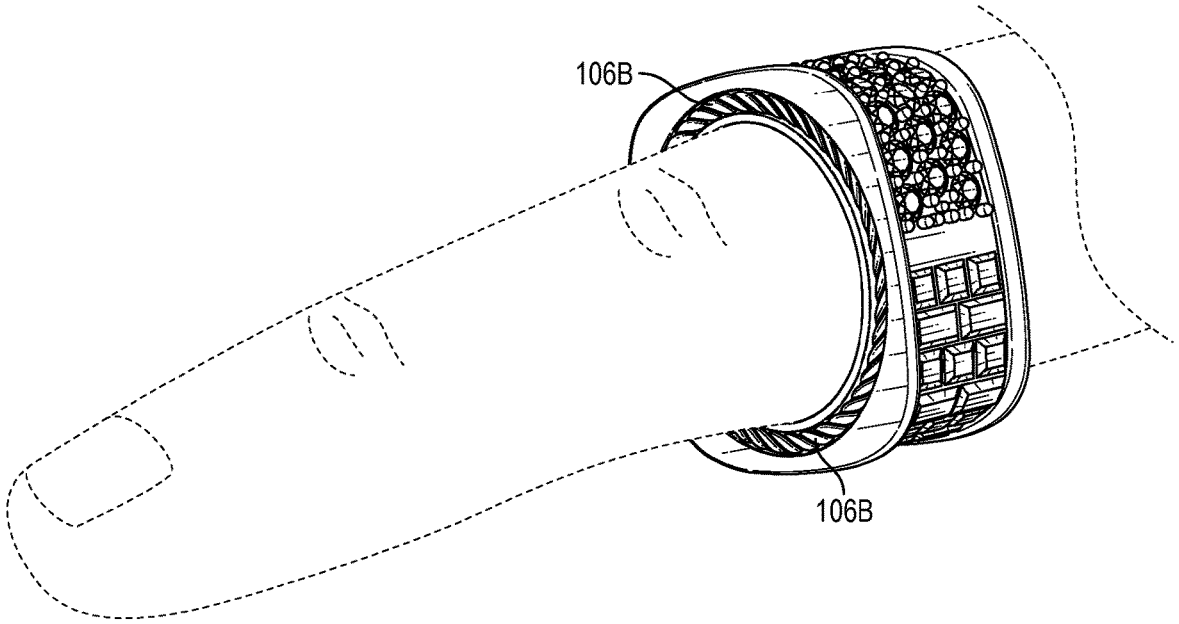
FIG. 11 is a fourth perspective view of a rotatable polymorphic ring to selectively display multiple jewels, metals, and colors, showing the ring on a finger, consistent with embodiments herein.

FIG. 11 is a fourth perspective view of the rotatable polymorphic ring of FIG. 9, turned around on the finger so that the rope feature 106B is facing in the outward direction from the person wearing the ring.

Figure 12:
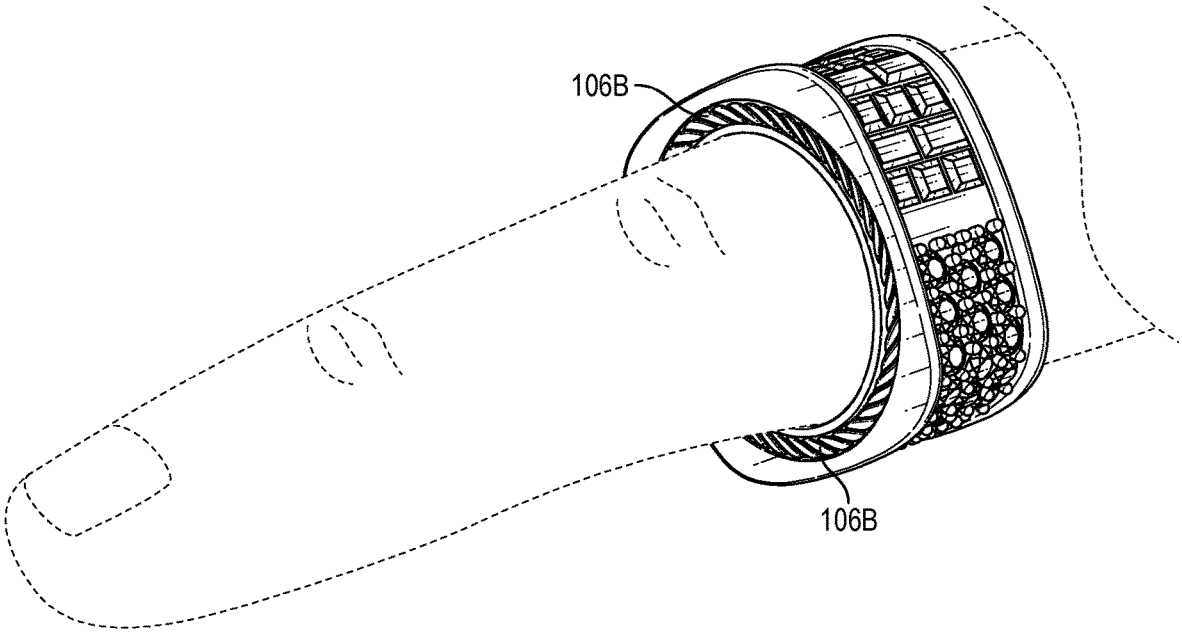
FIG. 12 is a fifth perspective view of a rotatable polymorphic ring to selectively display multiple jewels, metals, and colors, showing the ring on a finger, consistent with embodiments herein.

FIG. 12 is a fifth perspective view of the rotatable polymorphic ring of FIG. 10, turned around on the finger so that the rope feature 106B is facing in the outward direction from the person wearing the ring.

Figure 13:
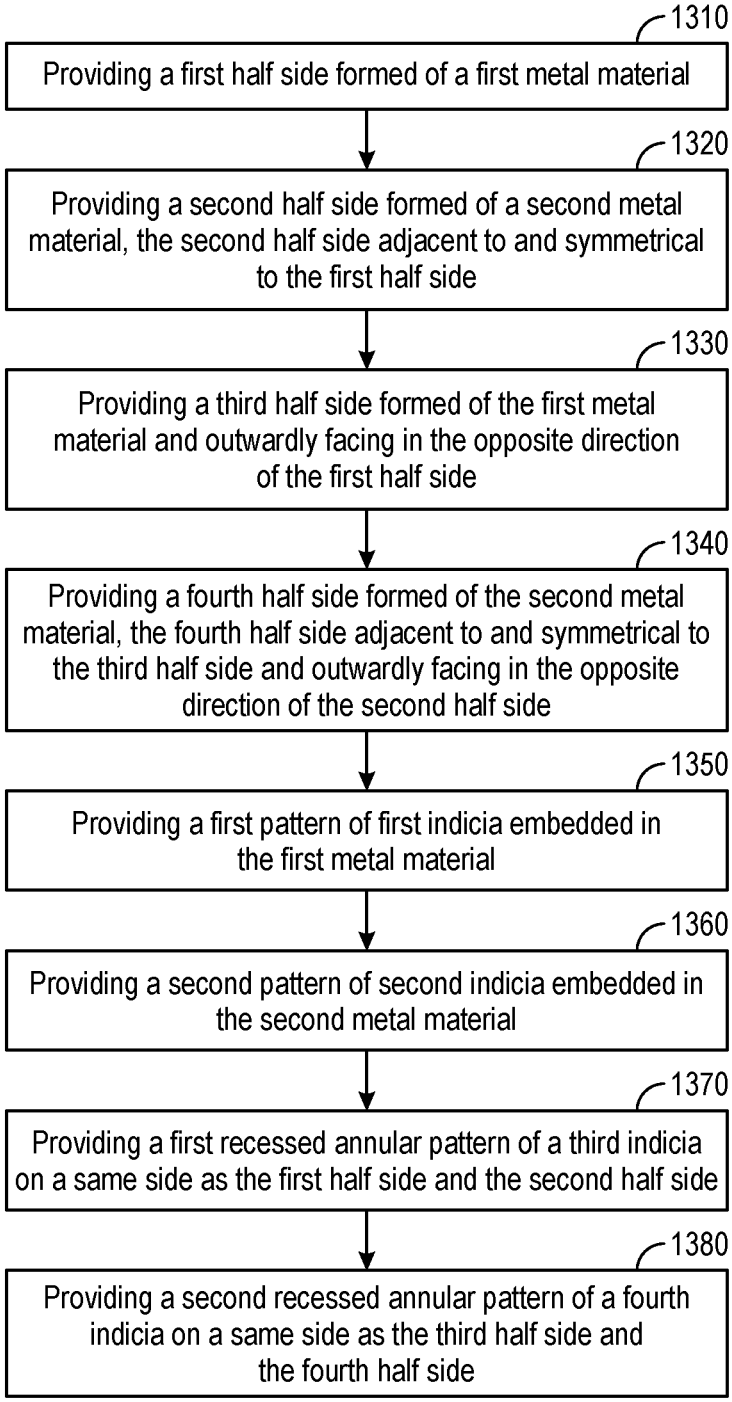
FIG. 13 is a flowchart of an example method for orienting at least two facets of a ring to selectively display at least two jewels, metals, or colors, of the ring, consistent with embodiments herein.

FIG. 13 is a flowchart of an example method for orienting at least two facets of a ring to selectively display at least two jewels, metals, or colors, of the ring.

At step 1310, the method provides a first half side formed (e.g., 102A) of a first metal material.

At step 1320, the method provides a second half side (e.g., 102B) formed of a second metal material, the second half side adjacent to and symmetrical to the first half side.

At step 1330, the method provides a third half side (e.g., 102C) formed of the first metal material and outwardly facing in the opposite direction of the first half side.

At step 1340, the method provides a fourth half side (e.g., 102D) formed of the second metal material, the fourth half side adjacent to and symmetrical to the third half side and outwardly facing in the opposite direction of the second half side.

At step 1350, the method provides a first pattern (e.g., 104A) of first indicia embedded in the first metal material.

At step 1360, the method provides a second pattern (e.g., 104B) of second indicia embedded in the second metal material.

At step 1370, the method provides a first recessed annular pattern (e.g., 106A, 106B) of a third indicia on a same side as the first half side and the second half side.

At step 1380, the method provides a second recessed annular pattern (e.g., 106B) of a fourth indicia on a same side as the third half side and the fourth half side.

An Additional Embodiment

Figure 14:
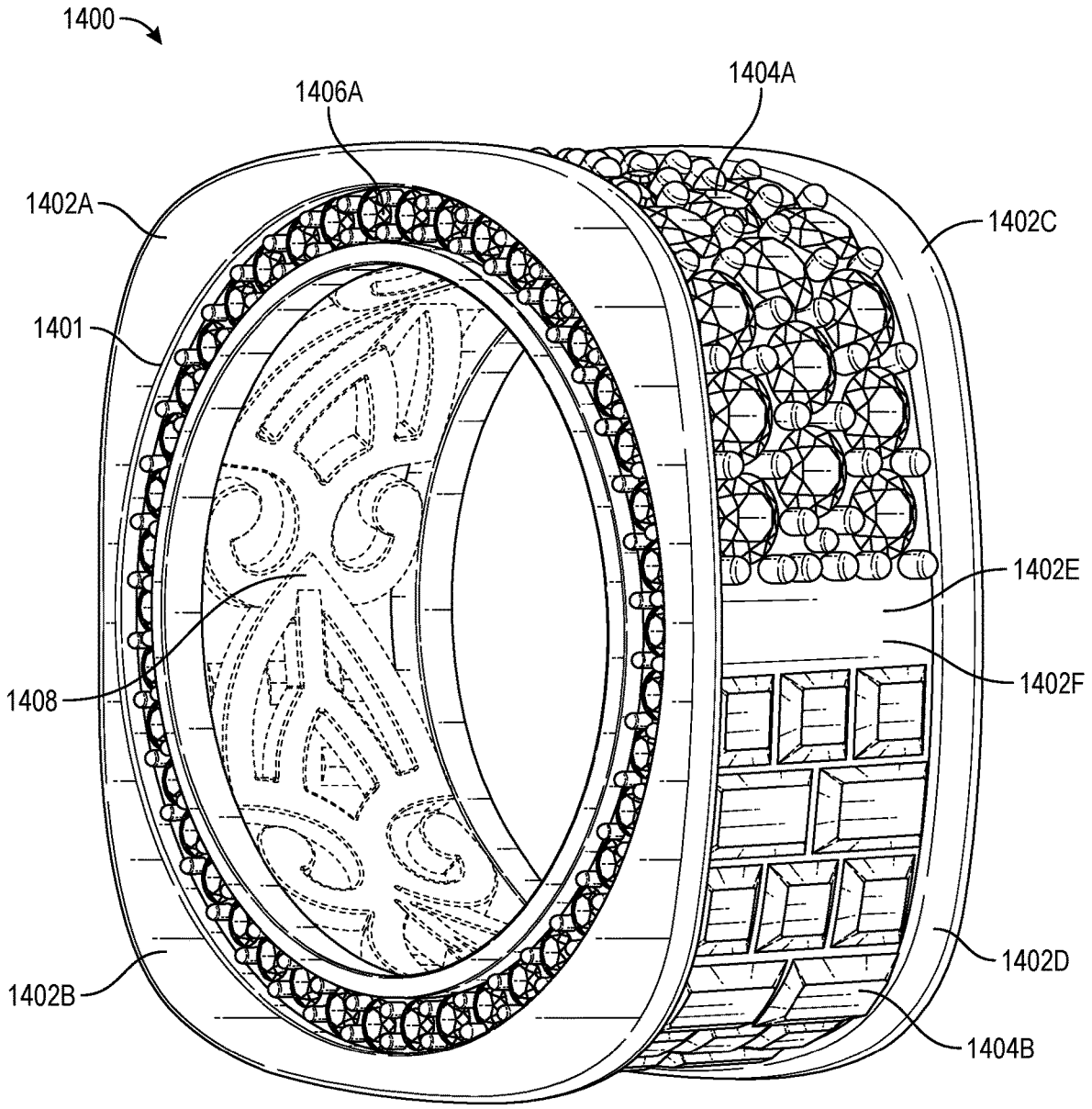
FIG. 14 is a sixth perspective view of a rotatable polymorphic ring to selectively display multiple jewels, metals, and colors, consistent with embodiments herein.

Another embodiment can be understood with reference to FIG. 14. FIG. 14 is a sixth perspective view of a rotatable polymorphic ring 1400 to selectively display multiple jewels, metals, and colors similar to FIG. 1, consistent with embodiments herein. In an embodiment, the first half side 1402A, the second half side 1402B, the third half side 1402C, and the fourth half side 1402D form an outside ring component. The outside ring component also includes the material on which the first jewels 1404A and the second jewels 1404B are mounted, as well as the first jewels 1404A and the second jewels 1404B. Further, the outside ring component includes the first metal material (as illustrated as 1402E) and the second metal material (as illustrated as 1402F).

In an embodiment, the outside ring component is coupled or connected to an inside ring component coaxially and by way of the outside ring completely encircling the inside ring, as depicted in FIG. 14. In an embodiment, the inside ring component includes the annular ring and its attributes or features that are coaxially aligned with the outside ring component. As seen in FIG. 14, the outside ring component and the inside ring component are coupled annularly along the inside edge of the outside ring component and the outside edge of the inside ring component as depicted by 1401.

In the embodiment shown in FIG. 14, the first recessed annular pattern 1406A, the second recessed annular pattern (not shown but similar to 106B), and the grill 1408 form part of the inside ring. The outside ring has a plurality of openings or transparent portions thereon through which a human eye or machine can see through to what is underneath. For example, there can be literal openings or spaces on the outside ring, where no material nor jewel is found. Further, the outside ring can be rotated with respect to the inside ring so that different portions of the inside ring are made visible through the different openings of the outside ring. Different designs can be shown at the same location, with respect to the rings being at the same location, for instance on the hand, by way of the coaxial outside and inside rings being rotated relative to each other. As another example, when at least one portion of the outside ring is transparent, the design of the grill 1408 is made visible through the outside portion, for example, via 1402E and 1402F, when such are thinly transparent.

The outside ring can be coupled or connected to the inside ring by a latch mechanism (not shown). A first part of the latch can be mounted on the outside ring and part thereof can fold over and clasp onto the inner ridge or inside part of the inside ring, in such a way that the two rings, the outside ring and the inside ring, continue to be rotatable with respect to each other. In another embodiment, the outside ring and the inside ring are configured so that the inside ring locks or snaps into place inside the outside ring, while maintaining rotatability. That is, the outside ring and the inside ring can still freely rotate with respect to one another.

In an embodiment, the inside ring can be worn alone, without the outside ring. For example, the inside ring can snap out from the outside ring and can be placed on the finger alone. The outer surface of the inside ring can be a gold band, for instance. In another instance, the outer surface of the inside ring can include jewels or designs embedded thereon.

Thus, when the outside ring has portions thereon that can be seen through, for example by the human eye, the design on the outer surface of the inside ring can be made visible, for example to the human eye, through the transparent portion of the outside ring. The designs can vary and can be displayed in a variety of ways, depending on how the outside ring is situated over the inside ring via rotation.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A polymorphic ring, comprising:

a first half side formed of a first metal material;

a second half side formed of a second metal material, the second half side adjacent to and symmetrical to the first half side;

a third half side formed of the first metal material and facing in an opposite direction of the first half side;

a fourth half side formed of the second metal material, the fourth half side adjacent to and symmetrical to the third half side and facing in an opposite direction of the second half side;

a first pattern of first indicia embedded in the first metal material;

a second pattern of second indicia embedded in the second metal material;

a first recessed annular pattern of a third indicia on a same side as the first half side and the second half side; and a second recessed annular pattern of a fourth indicia on a same side as the third half side and the fourth half side;

wherein the first and second recessed annular patterns are different from each other;

wherein the first half side and third half side collectively define a first unique design therebetween;

wherein the second half side and fourth half side collectively define a second unique design therebetween that is different from the first unique design; and wherein the first unique design and the second unique design define distinct facets each of which is either alternatively displayed or concealed based on selective rotation of the ring on a wearer's finger; and/or wherein the first and second recessed annular patterns are selectably displayed in alternative orientations based on 180° rotation of the ring about an axis that is perpendicular to the wearer's finger.

2. The ring of claim 1, wherein the first indicia, second indicia, third indicia, and fourth indicia are jewels or engravings.

3. The ring of claim 1, wherein the first metal material and the second metal material are any of: white gold, yellow gold, rose gold, or titanium steel.

4. The ring of claim 1, further comprising a grill design in an interior surface of the ring.

5. The ring of claim 4, wherein the grill design comprises a receptacle for placement of an element.

6. The polymorphic ring of claim 5, wherein the element is any of: a jewel, a radio-frequency identification (RFID) chip, or an electronic element configured to process a transaction.

7. The ring of claim 4, wherein the grill design comprises a serial number of the ring.

8. The ring of claim 1, wherein the first recessed annular pattern or the second recessed annular pattern comprises a plurality of jewels or a design formed in the metal thereof.

9. The ring of claim 1, wherein:

a width of the first pattern of first indicia comprises three spaced rounded jewels; or a width of the second pattern of second indicia comprises three spaced vertical rectangular jewels or two spaced horizontal rectangular jewels.

10. The ring of claim 1, wherein the first indicia, second indicia, third indicia, and fourth indicia comprise precious stones, the precious stones comprising any of or any combination of: diamonds, rubies, emeralds, and sapphires.

11. A method for orienting at least two facets of a polymorphic ring comprising:

providing a first half side formed of a first metal material;

providing a second half side formed of a second metal material, the second half side adjacent to and symmetrical to the first half side;

providing a third half side formed of the first metal material and outwardly facing in an opposite direction of the first half side;

providing a fourth half side formed of the second metal material, the fourth half side adjacent to and symmetrical to the third half side and facing in an opposite direction of the second half side;

providing a first pattern of first indicia embedded in the first metal material;

providing a second pattern of second indicia embedded in the second metal material;

providing a first recessed annular pattern of a third indicia on a same side as the first half side and the second half side; and providing a second recessed annular pattern of a fourth indicia on a same side as the third half side and the fourth half side;

wherein the first and second recessed annular patterns are different from each other;

wherein the first half side and third half side collectively define a first unique design therebetween;

wherein the second half side and fourth half side collectively define a second unique design therebetween that is different from the first unique design; and wherein the first unique design and the second unique design define distinct facets each of which is either alternatively displayed or concealed based on selective rotation of the ring on a wearer's finger; and/or wherein the first and second recessed annular patterns are selectably displayed in alternative orientations based on 180° rotation of the ring about an axis that is perpendicular to the wearer's finger.

12. The method of claim 11, wherein the first indicia, second indicia, third indicia, and fourth indicia are jewels or engravings.

13. The method of claim 11, wherein the first indicia, second indicia, third indicia, and fourth indicia comprise precious stones, the precious stones comprising any of or any combination of: diamonds, rubies, emeralds, and sapphires.

14. The method of claim 11, wherein the first metal material and the second metal material are any of: white gold, yellow gold, rose gold, or titanium steel.

15. The method of claim 11, further comprising:

providing a grill design in an interior surface of the ring.

16. The method of claim 15, wherein the grill design comprises a receptacle for placement of an element.

17. The method of claim 16, wherein the element is any of: a jewel, a radio-frequency identification (RFID) chip, or an electronic element configured to process a transaction.

18. The method of claim 15, wherein the grill design comprises a serial number of the ring.

* * * * *